US005201359A

United States Patent [19]

McMullen

[11] Patent Number: 5,201,359

[45] Date of Patent: Apr. 13, 1993

[54] RAPID SOLIDIFICATION APPARATUS

[75] Inventor: Alan T. McMullen, Anderson, Ind.

[73] Assignee: General Motors Corporation, Detroit, Mich.

[21] Appl. No.: 587,927

[22] Filed: Sep. 24, 1990

[51] Int. Cl.[5] ..... B22D 11/06

[52] U.S. Cl. ..... 164/423; 222/593

[58] Field of Search ..... 164/427, 429, 479, 423, 164/463, 488, 437; 222/593, 606, 607

[56] References Cited

FOREIGN PATENT DOCUMENTS 338261 10/1989 European Pat. Off. ..... 164/423
745427 2/1956 United Kingdom ..... 164/488
2112913 7/1983 United Kingdom ..... 164/429

*Primary Examiner*—Kuang Y. Lin
*Attorney, Agent, or Firm*—George A. Grove

[57] ABSTRACT

A melt spinning apparatus for casting a stream of rare earth element alloy against a quench wheel includes a tundish heated by a first induction heater; a flow nozzle of boron nitride material for directing molten metal through the outlet of the tundish for distribution against the quench wheel; the nozzle includes a jet forming orifice with a flow transition entrance configured to receive a moving charge of molten metal from the inlet of the nozzle through a large longitudinal bore in the nozzle so as to reduce erosion of the nozzle orifice and to smooth flow so as to produce a uniform casting stream.

8 Claims, 2 Drawing Sheets

RAPID SOLIDIFICATION APPARATUS

FIELD OF THE INVENTION

This invention relates to rapid solidification apparatus and more particularly to melt spinning apparatus for forming a jet stream of molten rare earth element containing molten metal alloy that is cast against the surface of a quench wheel to cool the molten metal to form a solid product with either an amorphous structure or a finely grained structure suitable for the manufacture of permanent magnet materials.

BACKGROUND OF THE INVENTION

Melt spinning apparatus for forming a solid amorphous or fine grained product from transition metal-rare earth element-boron type materials, especially iron-neodymium-boron type materials have included a tundish with a filler end and an outlet. A nozzle is located in the outlet for forming a fine jet stream of molten material that is quenched on a spinning wheel located closely adjacent the outlet of the nozzle. Prior apparatus for forming such a fine jet steam has included a first induction heater for heating the tundish to maintain a charge of the rare earth element containing metal alloy in a molten state for flow through the nozzle. Additionally, the apparatus may also have a second induction heater which surrounds the nozzle to maintain the molten metal at a viscosity which will enable it to flow through the nozzle and against the periphery of the spinning quench wheel.

In the past, such nozzles have been provided with an inwardly diverging entrance opening that communicates with a large bore formed through the full length of the nozzle. The nozzle has a flat surface at its outlet with a central orifice for forming the jet stream. The flow rate of the jet stream onto the periphery of the quench wheel is a function of the height of the molten material in the tundish as well as the temperature and composition of the material; the nozzle geometry including the shape of the entrance opening and the length and diameter of the large bore; the diameter and length of the orifice at the end of the nozzle; and the distance between the periphery of the quench wheel and the outlet of the discharge orifice from the nozzle.

It was believed that such nozzles should include an inwardly divergent entrance for the smooth flow of molten material into an elongated nozzle passage. It was further believed that the elongated nozzle passage should have a relatively large bore from the entrance of the nozzle leading to an orifice formed in a flat end wall of the nozzle to form a fine jet stream from the orifice.

When the orifice of such nozzle was eroded by the hot molten material, the flow rate of the melt increased to the point that the stream could not be cooled fast enough to obtain a desired microstructure. The production casting run then had to be shut down in order to replace an eroded nozzle with a new nozzle having a properly sized orifice.

A crucial factor in the production of good quality quenched solid product suitable for use in the manufacture of permanent magnet materials from the molten rare earth-containing material is that the outlet orifice diameter remain sufficiently close to its original size such that the melt stream can be suitably quenched by the spinning wheel.

Such prior art nozzles have used resistant refractory materials, such as boron nitride. Nevertheless, molten iron-neodymium-boron material eroded the orifice and the flow rate increased to the point that the material could no longer be quenched to a suitable amorphous or fine grained microstructure.

In order to improve the performance of nozzles, a series of experiments was undertaken to determine if the nozzle geometry could be varied so as to materially increase the duration of a casting run before nozzle wear at the outlet orifice required replacement of the nozzle. The experiments used a nozzle having the same stock material of boron nitride, the same tundish, the same induction heater, the same quench wheel and with only the geometry of the nozzle adjusted to determine if changes could be made to produce such material increases in the duration of casting runs.

SUMMARY OF THE INVENTION

Accordingly, an object of the present invention is to extend the duration of a melt spinning run in a melt spinning apparatus for forming solid ribbon-like particles from molten metal of a metal composition including iron-neodymium-boron which, when chilled, forms an amorphous or finely grained solid product suitable for use as permanent magnet material. Examples of such materials and practices are disclosed, e.g., in U.S. Pat. Nos. 4,496,395, 4,802,931 and 4,851,058.

Another object is to reduce orifice erosion wear and to provide a more consistent, stable flow of the molten iron-neodymium-boron type material from a nozzle in melt spinning apparatus so as to reduce quench variations in the solid product formed on a spinning quench wheel in such apparatus.

A feature of the apparatus is a nozzle design utilizing a surprisingly effective combination of outlet orifice length and transition shape from the main bore of the nozzle to the outlet orifice of the nozzle. Such transition shape and cooperating critical length of the outlet orifice have resulted in more than a doubling of the duration of the casting run while producing a doubled production of good quality solid rare earth element containing alloy for use in the manufacture of permanent magnet materials.

Specifically, the nozzle design of the present invention may retain both the overall length of the prior nozzle body and its molten metal inlet configuration so as to be adaptable to the same outlet of a standard tundish while the discharge end of the nozzle remains at the same spaced relationship with the outer periphery of a spinning quench wheel during a production run.

The nozzle design of the present invention includes a relatively large central bore extending from the nozzle toward the outlet orifice. The nozzle design further includes an extended length outlet orifice end with a smoothly-tapered transition surface connecting the orifice with the central bore. The transition surface is shaped as the frustum of a cone having a large diameter end of a dimension corresponding to that of the diameter of the large bore section and having a small diameter end dimensioned to correspond to the dimension of the diameter of the discharge orifice. In the new nozzle design, the small diameter end of the transition surface merges with the inlet end of a small diameter orifice which is a length greater than the length of the discharge orifice in prior art melt spinning nozzles.

The resultant nozzle structure of the present invention has a combination of central bore, transition surface and outlet orifice that are believed to cooperate to induce a more laminar, less turbulent flow in the moving charge of molten material of iron-neodymium-boron type composition. The extended length of the smaller diameter discharge orifice provides a residence section through which the molten material passes for a greater time to stabilize the transition flow from the transition flow section before it passes from the discharge orifice as a fine stream of molten material. The transition flow section and extended length orifice combine to reduce erosion of the discharge orifice by the material. Further, as erosion occurs, the increased resistance of the longer orifice maintains the flow rate at a level that can be suitably quenched by the cooled wheel. Thus, the transition in flow section and extended length orifice combine to produce a more stable, fine stream of molten material which has a diameter that is maintained more uniform during a prolonged production run such that a quench wheel produces solid product ribbon with little or no quench variation.

Other objects, features and advantages of the present invention will be more apparent from the following description of a preferred embodiment taken in conjunction with the following drawings wherein:

DETAILED DESCRIPTION OF A PREFERRED EMBODIMENT OF THE INVENTION

Figure 1:
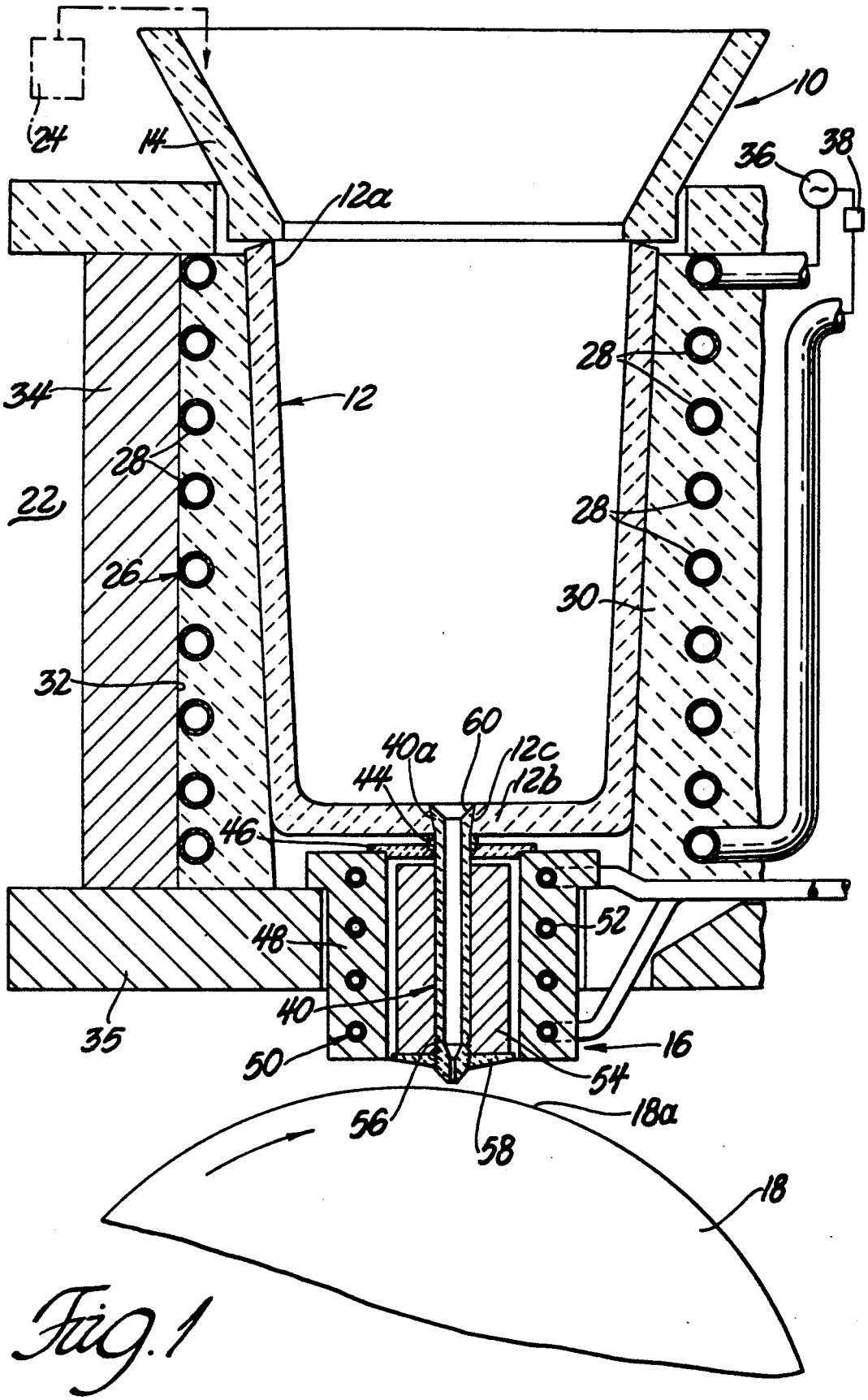
FIG. 1 is a vertical section view of melt spinning apparatus including a nozzle of the present invention.

Referring now to FIG. 1, a melt spinning apparatus 10 is illustrated of the type for rapid solidification of rare earth element containing molten metal alloys which, when suitably cooled, form solid ribbon particles having permanent magnet properties.

More specifically, the molten alloys suitably processed by the melt spinning apparatus 10 are molten alloys of iron-neodymium-boron or equivalent material. The apparatus 10 includes a tundish 12 for containing the molten metal. The tundish 12 has an open upper end 12*a* which receives a funnel 14 for directing the charge of molten metal into the tundish.

A flow shaping assembly 16 receives molten alloy from the tundish 12. The assembly is operative to direct a fine stream of molten metal against the outer periphery 18*a* of a water cooled quench wheel 18 where the molten metal is rapidly quenched and solidified in ribbon form with a microstructure that is either amorphous (no detectable grain structure) or of very fine grained structure. The quenched ribbon product is thrown from the spinning quench wheel as broken ribbon fragments which are very thin and in small particle form and are suitable for use as permanent magnet material.

In the formation of such ribbon material, the aforedescribed components are contained within a protective enclosure, not shown. The enclosure has its interior 22 purged of moisture and oxygen by a backfill of argon or other suitable inert gas which fills the interior 22 during a production run to be described in greater detail below.

A suitable charge of iron-neodymium-boron type alloy is melted in a separate furnace 24 which can be contained in the enclosure to exclude reaction of the molten metal with oxygen.

The molten material is poured through the funnel 14 into the tundish 12 as needed during a production run during which the vertical head of the molten metal in the tundish 12 is maintained at a substantially uniform height selected to assure adequate flow of molten metal through the flow shaping assembly 16. The charge of molten metal in the tundish is maintained at an elevated temperature by a first heater unit 26 including a water cooled copper induction heating coil 28 wound around the outside surface of the tundish 12. The coil 28 is embedded in a core 30 formed from a mixture of alumina rammed into a cavity 32 formed by a steel insulator board 34 around the tundish 12 which together with a steel base 35 forms a support for the tundish 12 and the molten metal contained therein.

The coil 28 is connected across a suitable power source 36 and is energized under the control of a power supply controller 38 to control current flow in the coil 28, which current flow induces eddy currents in the molten metal in the tundish 12 which will inductively heat the molten metal to keep the temperature elevated to a point at which the viscosity of the molten metal will flow through the flow shaping assembly 16 in a uniform manner throughout the production run.

The tundish 12, the core 30 and the funnel 14 are all made from a suitable form of refractory material such as alumina for containing the hot molten metal and for preventing oxidation of the containment components at elevated temperature conditions.

The bottom 12*b* of the tundish 12 has an opening 12*c* in which is located the inlet end 40*a* of a nozzle 40 for forming and directing the molten material quench wheel 18. The quench wheel 18 is connected to a suitable drive 42 in a known manner to spin the wheel at a controlled rate.

The nozzle 40 is supported by a washer 44 and plate 46 located about the inlet end 40*a* of the nozzle 40. The plate 46 is supported on a block 48 of alumina forming a coil support in a second heater unit 50. The heater unit 50 has a smaller water-cooled induction heating coil 52 embedded in the block 48 so as to be wound around a tubular member 54 forming a graphite susceptor inductively heated by the heater unit 50. As in the case of coil 28, the heating coil 52 is energized by power source 36 under the control of controller 38. The tubular member 54 is secured to a threaded end 56 of the nozzle by a heat shield member 58 that overlies the end of the tubular member 54 to insulate against heat loss from the end of the heater unit 50. Only a small quantity of molten metal is in the nozzle 40 when it is open to metal flow therethrough. Consequently, direct inductive heating of the metal is somewhat limited because only a limited eddy current pattern is formed in the material located within the nozzle 40 during a production run. In order to assure adequate heating of the nozzle 40 by the heater unit 50, the tubular member 54 is configured to be inductively heated to raise the temperature of the tubular member 54 to a level that defines a heat source for heating the nozzle 40 by direct conductive heat transfer from the tubular member 54 to the nozzle 40 such that the molten metal within the interior of the nozzle 40 is maintained at a viscosity for smooth flow from the nozzle 40 against the outer periphery of the quench wheel 18.

All other factors being constant, the most significant control of the quench rate of the molten metal stream on the quench wheel 18 is the velocity of rotation of the quench wheel 18. In a preferred embodiment, the outlet from the nozzle 40 is spaced about ⅛ inches from the outer circumferential surface 18*a* of the quench wheel at a point about one inch forward of the vertical diameter of the quench wheel such that the stream moving in a vertical downward direction will be spread by the controlled rate of rotation at the periphery of the quench wheel 18 in a manner to form a thin layer of material on the width of the circumferential surface 18*a*. The quench wheel may be made of any suitable metal such as copper or molybdenum, and it is water cooled by variable flow coolant sprays (not shown) so that the temperature of the quench wheel 18 can be controlled to produce an almost instantaneous solidification of the molten material as it hits the surface 18*a* of the quench wheel 18 to form a ribbon of solid metal. The solid metal ribbon is formed as an amorphous product with no detectable grains or the solid metal ribbon is formed as a very finely grained solid product which in either case is broken into ribbon fragments of small size. It has been found that such fine grained or amorphous solid metal product is especially suitable for permanent magnet material.

Figure 3:
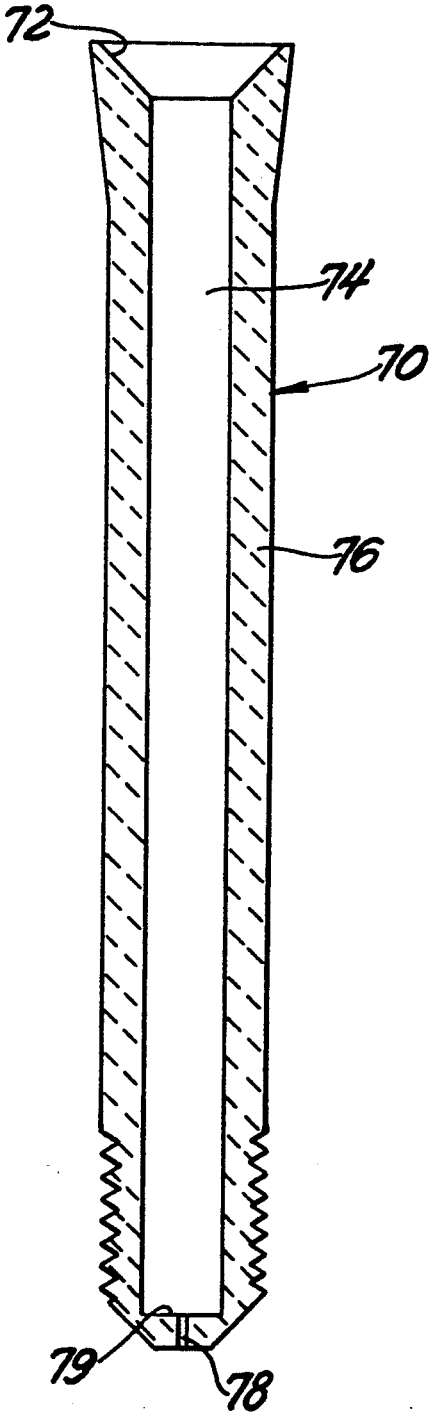
FIG. 3 is an enlarged sectional view of a prior art nozzle.

In the past, such apparatus has included a nozzle 70 of a length that will direct molten metal from the bottom opening 12*c* of a tundish 12 to a point approximately at the periphery of the quench wheel 18. The prior art nozzle 70 is shown in FIG. 3. It has a convergent entrance opening 72 leading to a relatively large central bore 74 formed through the full length of the nozzle. The wall 76 is of a thickness which will enable adequate heat flow by conduction from the tubular member 54 to the metal flowing through the nozzle 70. The fine stream of discharged molten metal is formed by an outlet orifice 78 at a flat surface 79 closing the end of the large bore 74 and forming an abrupt change in direction from the flow pattern through the large bore 74 into the orifice 78.

Such prior art nozzles have represented a limiting factor in the operation of the jet casting apparatus 10 since the boron nitride material in the nozzle 70 would erode at the entrance to the orifice 78 so as to change the fineness of the stream ejected from the nozzle 70 sufficiently so that the quench properties of the resultant solid amorphous material could no longer be maintained uniform as the duration of the production run continued.

Figure 2:
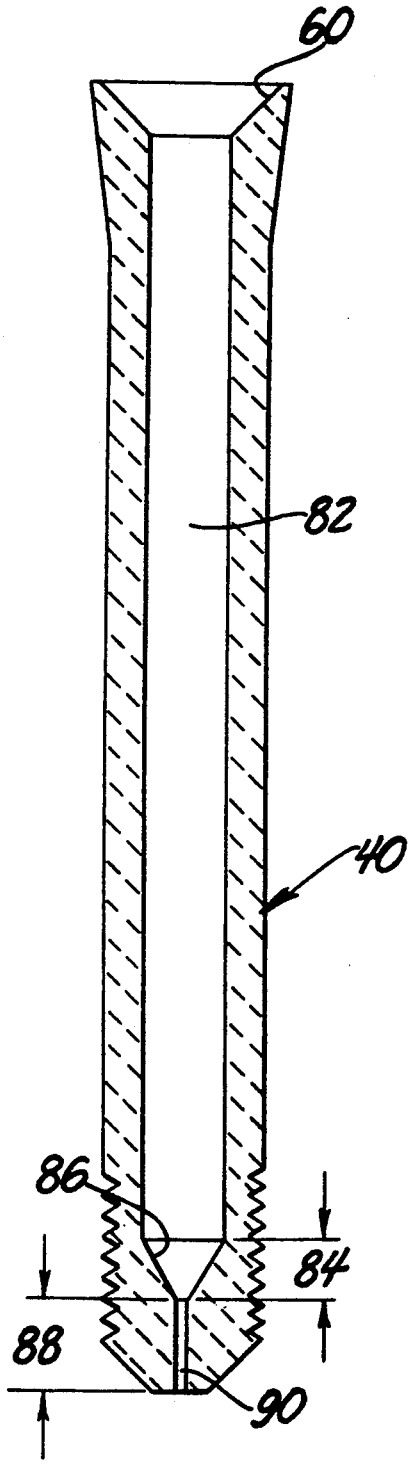
Fig. 2 PRIOR ART
FIG. 2 is an enlarged sectional view of the nozzle of the present invention.

Referring to FIG. 2, the nozzle 40 of the present invention can be located in the assembly 16 described above for operation with a standard tundish 12 and standard quench wheel 18. The length of the nozzle 40 is the same as the prior art nozzle 70. Also, the entrance opening 60 to the nozzle 40 has the same configuration as the entrance opening 72 of the prior art nozzle 70. The remainder of the nozzle 40, however, is modified in an unexpected manner to reduce the orifice erosion wear over time such that the production run of the apparatus 10 is more than doubled and the quantity of good quality solid ribbon product is commensurately increased.

To this end, the nozzle 40 includes a large bore 82 (e.g., 0.380 inch diameter) therein which is shorter than the large bore 74 in the prior art nozzle 70. The shortened large bore 82 communicates with a transition section 84 in the nozzle 40 defined by a surface 86 shaped as a frustum of a cone with an included angle of approximately 60 degrees. The transition section 84 communicates with a residence section 88 formed by an extended length orifice 90 approximately three times the length of the orifice in the prior art. More particularly, in the present invention, the residence section 88 formed by the length of orifice 90 for producing a residence time to assure formation of a constant diameter fine stream over extended duration production runs is between 0.450 to 0.500 inches. This orifice length is employed in combination with an orifice diameter between 0.037 and 0.040 inches. This orifice diameter and length cooperate to facilitate both start up and prolonged operation of the melt spinning practice. The nozzle 40 has an overall six inch length to mate with known jet casting apparatus for forming a solid magnetic product.

Since the length of orifice 90 in the nozzle 40 of the present invention is extended, the flow time through the fine stream forming orifice is increased. The flow is thereby stabilized as it is necked down from the flow pattern in the large bore 82 into the small diameter flow pattern in the orifice 90. Such stabilization of the metal occurs before the molten metal is ejected from the nozzle 40 such that a more uniform fine stream is formed for contact with the quench wheel 18. A more uniform fine stream results in more uniform quench properties of the resultant solid product of permanent magnet material throughout the extended production run. The more uniform quench properties result in higher yields of material suitable for use as permanent magnet material.

The transition section 84 also smooths the flow from the large bore 82 to the extended length orifice 90 so that there is less erosion at the entrance to the orifice 90 and accordingly the size of the fine stream will remain consistent over longer production runs.

It will be appreciated that more than one nozzle may be employed with a single tundish and that a nozzle may be constructed to have more than one bore and outlet orifice and maintain the same good quality, solid rare earth element as with the single orifice nozzle.

It will be understood by those skilled in the art that the foregoing description is of a preferred embodiment of the disclosed apparatus, and that various changes and modifications may be made to the present invention without departing from the spirit and scope thereof as covered by the following claims.

The embodiments of the invention in which an exclusive property or privilege is claimed are defined as follows:

1. A melt spinning apparatus having a tundish with an outlet in which is supported a boron nitride nozzle for directing a molten stream of iron-rare earth element-boron containing alloy against a quench wheel supported below the outlet of the nozzle for receiving a molten stream of the alloy and rotatable at a controlled rate for receiving and cooling the molten metal stream from the nozzle to substantially instantaneously solidify the molten metal to form an amorphous product or a very finely grained solid product comprised of such composition and wherein the apparatus is characterized by:

said nozzle having an inlet and a tubular portion having a wall defining a large diameter longitudinal bore in communication with said inlet; said longitudinal bore having a predetermined length for forming a uniformly moving mass of molten metal in the nozzle during a melt spinning run in which the molten metal is directed from the tundish through said nozzle inlet;

an end wall closing said tubular portion having an orifice with an inlet and an outlet for forming a small diameter stream of molten metal and for directing the small diameter stream of molten metal against the periphery of said spinning wheel, said orifice having a length from 0.450 to 0.500 inches;

flow transition means at the inlet of said orifice thereof for providing a transition flow area from said large diameter longitudinal bore through said orifice for reducing flow-induced erosion at the inlet end of said orifice and to flow the molten metal from the large diameter longitudinal bore in a convergent pattern which forms a uniformly contracted inlet stream of molten metal to said orifice for controlling the uniformity of the diameter of the molten stream issuing from said orifice for contact with the periphery of the quench wheel.

2. The melt spinning apparatus of claim 1 further characterized by said flow transition means being a frustoconical surface formed at the downstream end of said tubular portion; said frustoconical surface having a large diameter entrance end substantially equal to the diameter of said large diameter longitudinal bore and directly connected to the outlet end of said large diameter longitudinal bore; said frustoconical surface further having an outlet diameter substantially equal to the diameter at the inlet end of said orifice.

3. The melt spinning apparatus of claim 1 further characterized by said flow transition means being a frustum of a cone having a slope of approximately 60 degrees and including an inlet diameter and an outlet diameter; said inlet diameter of said frustum of a cone being substantially equal to the diameter of said large diameter longitudinal bore and said outlet diameter of said frustum of a cone being substantially equal to the diameter of said orifice.

4. The melt spinning apparatus of claim 3 further characterized by said orifice having a length between 0.450 to 0.500 inches and a diameter in the range of 0.037 to 0.040 inches.

5. A melt spinning apparatus having a tundish with an outlet in which is supported a boron nitride nozzle for directing a molten stream of iron-rare earth element-boron containing alloy against a quench wheel supported below the outlet of the nozzle for receiving a molten stream of the alloy and rotatable at a controlled rate for receiving and cooling the molten metal stream from the nozzle to substantially instantaneously solidify the molten metal to form an amorphous product or a very finely grained solid product comprised of the alloy composition and wherein the tundish is heated by a first induction heater and the nozzle is heated by a second induction heater characterized by:

said boron nitride nozzle having an end-to-end length which extends from the outlet of the tundish to a point adjacent the periphery of the quench wheel;

said nozzle having an inlet and a tubular portion having a wall extending through the length of said tubular portion defining a large diameter longitudinal bore in communication with said inlet;

a graphite susceptor surrounding said wall of said nozzle in direct contact therewith; said second inductive heater heating said graphite susceptor; said wall having a first predetermined thickness for conductively transferring heat from said graphite susceptor at a rate which will maintain the molten state of the metal as its flow through the nozzle from the tundish against the quench wheel;

said longitudinal bore having a predetermined length for forming a uniformly moving mass of molten metal in the nozzle during a melt spinning run in which the molten metal is directed from the tundish through said nozzle inlet;

an end wall closing said tubular portion having a wall thickness greater than the wall thickness of said tubular portion and said end wall having an orifice with an inlet and an outlet for forming a small diameter stream of molten stream and for directing the small diameter stream of molten metal against the periphery of said spinning wheel, said orifice having a length from 0.450 to 0.500 inches;

flow transition means at the inlet of said orifice thereof for providing a transition flow area from said large diameter longitudinal bore through said orifice for reducing flow-induced erosion at the inlet end of said orifice and to flow the molten metal from the large diameter longitudinal bore in a convergent pattern which forms a uniformly contracted inlet stream of molten metal to said orifice for controlling the uniformity of the diameter of the molten stream issuing from said orifice for contact with the periphery of the quench wheel.

6. The melt spinning apparatus of claim 5 further characterized by said flow transition means being a frustoconical surface formed at the downstream end of said tubular portion; said frustoconical surface having a large diameter entrance end substantially equal to the diameter of said large diameter longitudinal bore and directly connected to the outlet end of said large diameter longitudinal bore; said frustoconical surface further having an outlet diameter substantially equal to the diameter at the inlet end of said orifice.

7. The melt spinning apparatus of claim 5 further characterized by said flow transition means being a frustum of a cone having a slope of approximately 60 degrees and including an inlet diameter and an outlet diameter; said inlet diameter of said frustum of a cone being substantially equal to the diameter of said large diameter longitudinal bore and said outlet diameter of said frustum of a cone being substantially equal to the diameter of said orifice.

8. The melt spinning apparatus of claim 7 further characterized by said orifice having a length between 0.450 to 0.500 inches and a diameter in the range 0.037 to 0.040 inches.

* * * * *